US006562765B1

(12) United States Patent
Boffa

(10) Patent No.: US 6,562,765 B1
(45) Date of Patent: May 13, 2003

(54) OIL COMPOSITIONS HAVING IMPROVED FUEL ECONOMY EMPLOYING SYNERGISTIC ORGANOMOLYBDENUM COMPONENTS AND METHODS FOR THEIR USE

(75) Inventor: Alexander B. Boffa, Richmond, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 10/194,124

(22) Filed: Jul. 11, 2002

(51) Int. Cl.[7] ..... C10M 135/18; C10M 141/12

(52) U.S. Cl. ..... 508/221; 508/287; 508/293; 508/295; 508/363; 508/364; 508/365; 508/419; 508/543

(58) Field of Search ..... 508/221, 287, 508/363, 364, 365, 293, 295, 419, 543

(56) References Cited

U.S. PATENT DOCUMENTS

| | | | | |
|---|---|---|---|---|
| 4,259,194 | A | | 3/1981 | deVries et al. |
| 4,259,195 | A | | 3/1981 | King et al. |
| 4,261,843 | A | | 4/1981 | King et al. |
| 4,263,152 | A | | 4/1981 | King et al. |
| 4,265,773 | A | | 5/1981 | deVries et al. |
| 4,272,387 | A | | 6/1981 | King et al. |
| 4,283,295 | A | | 8/1981 | deVries et al. |
| 4,285,822 | A | | 8/1981 | deVries et al. |
| 4,315,826 | A | | 2/1982 | Schlicht et al. |
| 4,369,119 | A | | 1/1983 | deVries et al. |
| 4,395,343 | A | | 7/1983 | deVries et al. |
| 4,402,840 | A | | 9/1983 | deVries et al. |
| 4,474,673 | A | | 10/1984 | Hunt et al. |
| 4,479,883 | A | | 10/1984 | Shaub et al. |
| 4,501,678 | A | | 2/1985 | Katayama et al. |
| 5,672,572 | A | | 9/1997 | Arai et al. |
| 5,814,587 | A | | 9/1998 | Vrahopoulou et al. |
| 5,858,931 | A | | 1/1999 | Tanaka et al. |
| 6,017,858 | A | * | 1/2000 | Karol et al. ..... 508/303 |
| 6,074,993 | A | * | 6/2000 | Waddoups et al. ..... 508/364 |
| 6,174,842 | B1 | | 1/2001 | Gatto et al. |
| 6,245,725 | B1 | | 6/2001 | Tanaka et al. |
| 6,268,316 | B1 | * | 7/2001 | Tanaka et al. ..... 508/291 |
| 6,300,291 | B1 | | 10/2001 | Hartley et al. |
| 6,306,802 | B1 | * | 10/2001 | Shaub ..... 508/364 |
| 6,323,162 | B1 | * | 11/2001 | Yasunori et al. ..... 508/192 |
| 6,358,894 | B1 | | 3/2002 | Leta et al. |
| 6,369,005 | B1 | * | 4/2002 | Karol et al. ..... 508/364 |
| 6,423,671 | B1 | * | 7/2002 | Haruna ..... 508/365 |

FOREIGN PATENT DOCUMENTS

| | | |
|---|---|---|
| GB | 2097422 | * 11/1982 |

* cited by examiner

*Primary Examiner*—Jacqueline V. Howard
(74) *Attorney, Agent, or Firm*—Joseph P. Foley; Claude J. Caroli

(57) ABSTRACT

An engine oil having a base oil and a friction reducing amount of an oil soluble sulfurized or unsulfurized oxymolybdenum complex prepared from reacting, in the presence of a polar promoter, an acidic molybdenum compound and a basic nitrogen compound and a low concentration of a sulfurized oxymolybdenum dialkyldithiocarbamate; employed together to provide at least 450 parts per million of molybdenum and less than 175 parts per million of molybdenum from the dialkyldithiocarbamate, both on the basis of the engine oil.

27 Claims, 1 Drawing Sheet

Figure 1:
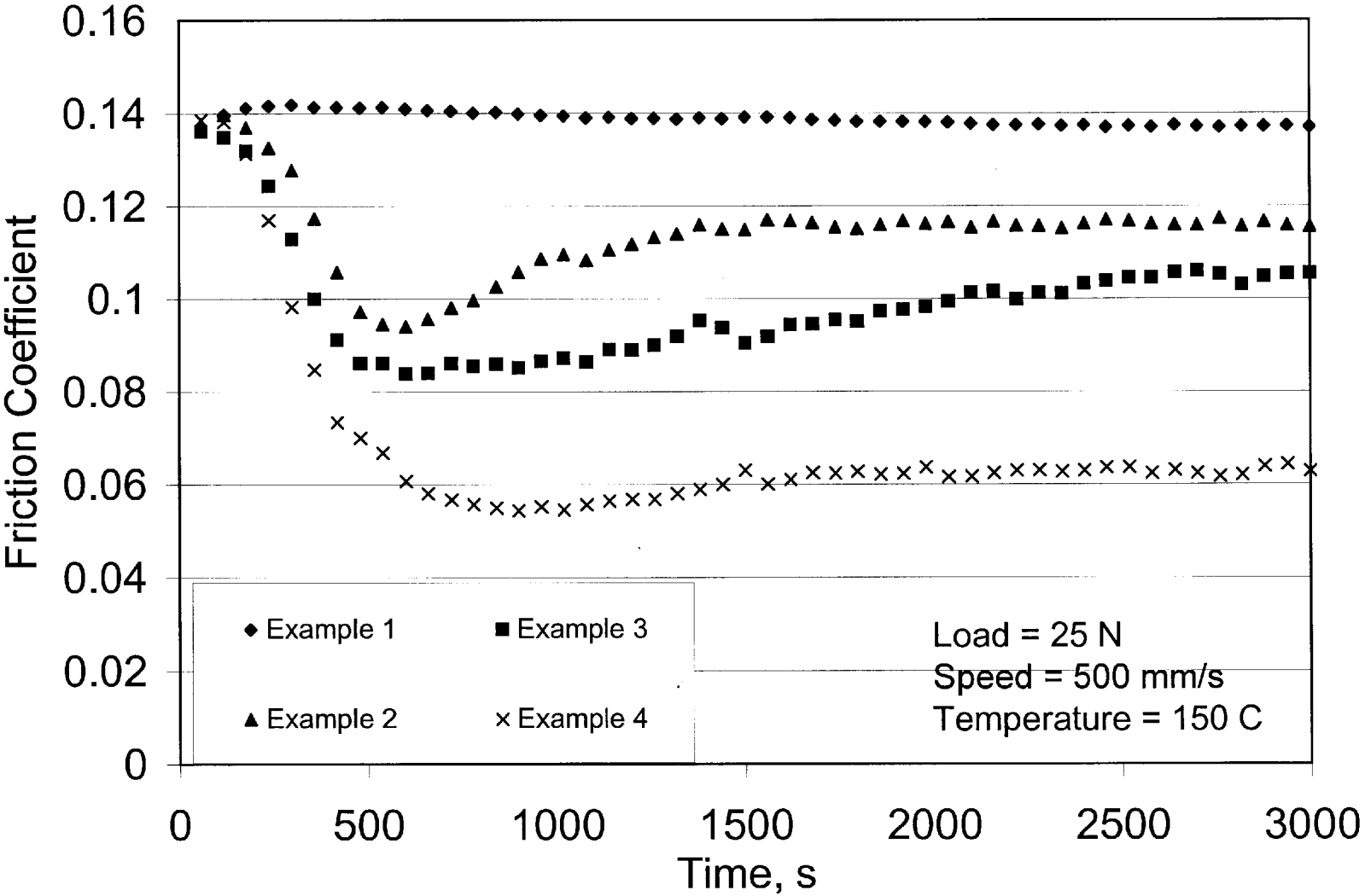

OIL COMPOSITIONS HAVING IMPROVED FUEL ECONOMY EMPLOYING SYNERGISTIC ORGANOMOLYBDENUM COMPONENTS AND METHODS FOR THEIR USE

FIELD OF THE INVENTION

The present invention relates to improved low friction oil compositions using lubrication additives and to methods for improving friction reduction in employing lubricating oils prepared therefrom. More specifically, the invention relates to a friction modifier additive containing a combination of organomolybdenum compounds which demonstrate a synergistic combination as a friction modifier in lubricating oils.

BACKGROUND OF THE INVENTION

Motor vehicle manufacturers have sought to improve fuel economy through engine design but also through designing engines which take advantage of new performance oils which have better fuel efficiency, oxidative stability, volatility, and improved viscosity index to name a few characteristics over conventional formulations. Engine oils have played an important role in improving fuel economy and resulting improved emission characteristics of motor vehicles, due to their low cost per unit in fuel efficiency in comparison with engine hardware changes. To reduce friction and improve fuel efficiency, there has been a drive to use lower viscosity engine oils, which often requires new additive package formulations. High on the list of requirements for these new formulated engine oil specifications are those employing friction modifiers in the lubricating oil composition. In this case, the additive system design is the crucial factor playing close attention to the additive/additive and additive/base fluid interactions.

Engine oil acts as a lubricant between moving engine parts at various conditions of load, speed and temperature. Hence, the various engine components experience different combinations of boundary layer, mixed and (elasto) hydrodynamic regimes of lubrication; with the largest frictional losses at piston liner/piston ring interface and a smaller part by the bearing and valve train. To reduce the energy losses due to friction of the various parts and to prevent engine wear, additives are incorporated into the engine oil such as friction modifiers, anti-wear agents, antioxidants, dispersants, detergents, etc. Also to reduce the hydrodynamic friction in the piston/cylinder the viscosity of engine oils has been lowered which has increased the dependence of friction modifiers to offset the new boundary layer regime.

Friction modifiers have been around for several years for application in limited slip gear oils, automatic transmission fluids, slideway lubricants and multipurpose tractor fluids. With the desire for increased fuel economy, friction modifiers have been added to automotive crankcase lubricants and several are known in the art. Well known friction modifiers can be classified into different groups regarding their function. Mechanically working friction modifiers are generally used in solid lubricating compounds, e.g. molybdenum disulfide, graphite, PTFE, polyamide; adsorption layer forming friction modifiers include, for example, higher fatty acids, e.g. oleic acid and stearic acid; higher alcohols, e.g. oleyl alcohol; esters; amines; sulfide oils. Friction polymer forming friction modifiers are generally ethoxylated dicarboxyclic acid partial esters, dialkyl phtalic acid esters, methacrylates, unsaturated fatty acids, and the remaining class is referred to as organometallic compounds represented by copper containing organic compounds and molybdenum compounds such as molybdenum dithiophosphates, molybdenum dithiocarbamates.

Friction modifiers generally operate at boundary layer conditions at temperatures where anti-wear and extreme pressure additives are not yet reactive by forming a thin mono-molecular layers of physically adsorbed polar oil-soluble products or reaction layers which exhibit a significantly lower friction compared to typical anti-wear or extreme pressure agents. However, under more severe condition and in mixed lubrication regime these friction modifiers are added with an anti-wear or extreme pressure agent. The most common type is a zinc dithiophosphate (ZnDTP) or zinc dithiocarbamate (ZnDTC).

However, when friction modifiers are added with other polar additives which also have an affinity to metal surfaces such as anti-wear, extreme pressure, anti-corrosion as well as detergents and dispersants, the friction modifier can compete for the active surface site or interact with each other. For example, anti-wear agents such as ZnDTP and ZnDTC protect closely approaching metal surfaces from asperities from damaging the opposite surface. These films are semi-plastic which are difficult to shear off so that under shearing conditions, their coefficient of friction is generally high. Conversely, a friction modifier generally operates by building an orderly and closely packed arrays of multi-molecule layers which are attracted to the metal surface via their polar heads and aligned to each other via Van der Waal forces. Therefore, when surface active agents such as anti-wear agents ZnDTP, a friction modifier or a detergent are added to a lubricating oil, the adsorption of the anti-wear agent is reduced by the competitive adsorption of the other agents. Accordingly, the selection of components and interactions between them is of major concern and synergistic interactions are not expected or possible to anticipate. Thus synergies when discovered, especially when found at concentrations of additives not employed or useful for that purpose in the art, further the advances and new requirements for formulating new oil compositions.

Molybdenum compounds are known in the art to be useful as antioxidants, friction modifiers and to provide anti-wear and extreme pressure resistance properties in lubricating oils. For example:

U.S. Pat. Nos. 4,259,194; 4,259,195; and 4,261,843 disclose antioxidant additives for lubricating oil that are prepared by combining a polar promoter, an acidic molybdenum compound, and certain basic nitrogen compounds to form a molybdenum-containing composition.

U.S. Pat. No. 4,265,773 discloses antioxidant additives for lubricating oil that are prepared by combining an acidic molybdenum compound, an oil-soluble basic nitrogen compound, and carbon disulfide to form a sulfur— and molybdenum-containing composition.

U.S. Pat. Nos. 4,263,152 and 4,272,387 discloses antioxidant additives for lubricating oil that are prepared by combining an acidic molybdenum compound, a basic nitrogen compound complex, and a sulfur source to form a sulfur— and molybdenum-containing composition.

U.S. Pat. No. 4,283,295 discloses antioxidant additives for lubricating oil that are prepared by combining a polar promoter, ammonium tetrathiomolybdate, and a basic nitrogen compound complex to form a sulfur— and molybdenum-containing composition.

U.S. Pat. No. 4,285,822 discloses antioxidant additives for lubricating oil that are prepared by (1) combining a polar solvent, an acidic molybdenum compound, and an oil-soluble basic nitrogen compound to form a molybdenum-containing complex and (2) contacting said complex with carbon disulfide to form a sulfur—and molybdenum—containing composition.

U.S. Pat. No. 4,315,826 discloses multipurpose lubricant additives that are prepared by reaction of carbon disulfide with thiomolybdenum derivatives of polyalkenylsuccinimides having basic nitrogen functions. It is said that the subject additives function as dispersants possessing excellent antifriction properties and impart anti-wear and anti-oxidant properties to a lubricant.

U.S. Pat. No. 4,369,119 discloses antioxidant additives for lubricating oil that are prepared by combining (a) a sulfur-containing molybdenum compound prepared by reacting an acidic molybdenum compound, a basic nitrogen compound, and a sulfur compound, with (b) an organic sulfur compound.

U.S. Pat. No. 4,395,343 discloses antioxidant additives for lubricating oil that are prepared by combining (a) a sulfur containing molybdenum compound prepared by reacting an acidic molybdenum compound, a basic nitrogen compound, and carbon disulfide, with (b) an organic sulfur compound.

U.S. Pat. No. 4,402,840 discloses antioxidant additives for lubricating oil that are prepared by combining (a) a sulfur containing molybdenum compound prepared by reacting an ammonium thiomolybdate compound, and a basic nitrogen compound, with (b) an organic sulfur compound.

U.S. Pat. No. 4,474,673 discloses antifriction additives for lubricating oil that are prepared by reacting a sulfurized organic compound having an active hydrogen or potentially active hydrogen with a molybdenum halide.

U.S. Pat. No. 4,479,883 discloses a lubricating oil composition that is said to have particularly improved friction reducing properties that comprises an ester of a polycarboxylic acid with a glycol or glycerol and a selected metal dithiocarbamate and that contains a relatively low level of phosphorus.

U.S. Pat. No. 4,501,678 discloses a lubricant containing molybdenum dialkyldithiocarbamates that is said to be useful for improving the fatigue life of gears.

It is well known in the art that formulating engine oils there is a competitive adsorption between friction modifiers and other surface active agents. U.S. Pat. Nos. 5,672,572 and 5,814,587 disclose that anti-wear agents such as ZDDP compete with organomolybdenum compounds for the metal surface.

SUMMARY OF THE INVENTION

This invention is directed to the unexpected synergy and resulting low friction coefficient in lubricating compositions containing a major amount of an oil of lubricating viscosity and at least 450 parts per million of molybdenum based upon the total mass of the composition of a friction modifier containing an unsulfurized and/or sulfurized oxymolybdenum nitrogen dispersant complex and a sulfurized oxymolybdenum dithiocarbamate employed at a low concentration.

The unsulfurized or sulfurized oxymolybdenum containing composition can be prepared by (i) reacting an acidic molybdenum compound and a basic nitrogen compound selected from the dispersant group consisting of succinimide, a carboxylic acid amide, a hydrocarbyl monoamine, a phosphoramide, a thiophosphoramide, a Mannich base, a dispersant viscosity index improver, or a mixture thereof in the presence of a polar promoter, to form an oxymolybdenum complex. This oxymolybdenum complex can be reacted with a sulfur containing compound, to thereby form a sulfurized oxymolybdenum containing composition, useful within the context of this invention. Preferably the dispersant is a polyisobutenyl succinimide. The oxymolybdenum or sulfurized oxymolybdenum containing compositions may be generally characterized as a sulfur/molybdenum complex of a basic nitrogen dispersant compound preferably with a sulfur to molybdenum weight ratio of about (0.01 to 1.0) to 1 and more preferably from about (0.05 to 0.5) to 1 and a nitrogen to molybdenum weight ratio of about (1 to 10) to 1 and more preferably from (2 to 5) to 1. The precise molecular formula of these oxymolybdenum compositions are not known with certainty. However, they are believed to be compounds in which molybdenum, whose valences are satisfied with atoms of oxygen or sulfur, is either complexed by, or the salt of one or more nitrogen atoms of the basic nitrogen atoms of the basic nitrogen containing compound used in the preparation of these compositions. In one aspect, the oxymolybdenum complex is prepared at a reaction temperature at or below 120 degrees centigrade and if optionally sulfurized, it is also reacted at or below 120 degrees centigrade. Such a process yields a lighter color product when compared to higher temperature reaction conditions at equivalent pressure.

In addition to the oxymolybdenum nitrogen containing dispersant described above, the present invention includes a small amount of a molybdenum dithiocarbamate of the formula I

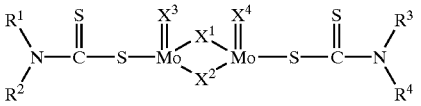

wherein $R^1$, $R^2$, $R^3$ and $R^4$, are independently selected from a hydrocarbon group; $X^1$ to $X^4$ are independently selected from sulfur or oxygen atom; wherein said molybdenum dithiocarbamate is present below 175 ppm in terms of molybdenum concentration, based upon the total mass of the lubricant composition. In a preferred aspect, the molybdenum dithiocarbamate is present from 10 to 175, more preferably 25 to 150, also preferred below 100 and from 50 to 90, all in terms of ppm of molybdenum concentration of the molybdenum dithiocarbamate, based upon the total mass of the composition.

Lubricating oils comprising a major amount of an oil of lubricating viscosity with a) an oxymolybdenum nitrogen containing dispersant and b) a molybdenum dithiocarbamate can be employed at a ratio of a) to b) from 2:1 to 20:1 and preferably from 5:1 to 10:1. Additionally, such compositions can further comprise a detergent, preferably a calcium phenate and/or an ashless dithiocarbamate.

The compositions exhibit a synergistic reduction in the measured friction coefficient and accordingly are useful for reducing the friction characteristics when employed in a lubricating oil. Therefore, another aspect is directed to uses and to methods for improving the friction reduction performance in lubricating oil by adding an effective amount of an oil soluble or dispersible amount to the friction modifier composition described herein.

BRIEF DISCRIPTION OF THE DRAWING

FIG. 1 is a graph of the dimensionless friction coefficient as function of time for the lubricating oil formulations employed in Examples 1–5.

DETAILED DESCRIPTION

The lubricant compositions of this invention include a major amount of base oil of lubricating viscosity. Base Oil as used herein is defined as a base stock or blend of base stocks which is a lubricant component that is produced by a single manufacturer to the same specifications (independent of feed source or manufacturer's location): that meets the same manufacturer's specification; and that is identified by a unique formula, product identification number, or both. Base stocks may be manufactured using a variety of different processes including but not limited to distillation, solvent refining, hydrogen processing, oligomerization, esterification, and rerefining. Rerefined stock shall be substantially free from materials introduced through manufacturing, contamination, or previous use. The base oil of this invention may be any natural or synthetic lubricating base oil fraction particularly those having a kinematic viscosity at 100 degrees Centigrade (C) and about 5 centistokes (cSt) to about 20 cSt, preferably about 7 cSt to about 16 cSt, more preferably about 9 cSt to about 15 cSt. Hydrocarbon synthetic oils may include, for example, oils prepared from the polymerization of ethylene, i.e., polyalphaolefin or PAO, or from hydrocarbon synthesis procedures using carbon monoxide and hydrogen gases such as in a Fisher-Tropsch process. A preferred base oil is one that comprises little, if any, heavy fraction; e.g., little, if any, lube oil fraction of viscosity 20 cSt or higher at 100 degrees C.

The base oil may be derived from natural lubricating oils, synthetic lubricating oils or mixtures thereof. Suitable base oil includes base stocks obtained by isomerization of synthetic wax and slack wax, as well as hydrocrackate base stocks produced by hydrocracking (rather than solvent extracting) the aromatic and polar components of the crude. Suitable base oils include those in all API categories I, II, III, IV and V as defined in API Publication 1509, 14th Edition, Addendum I, Dec. 1998. Saturates levels and viscosity indices for Group I, II and III base oils are listed in Table 1. Group IV base oils are polyalphaolefins (PAO). Group V base oils include all other base oils not included in Group I, II, III, or IV. Although Group II, III and IV base oils are preferred for use in this invention, these preferred base oils may be prepared by combining one or more of Group I, II, III, IV and V base stocks or base oils.

TABLE 1

Saturates, Sulfur and Viscosity Index of Group I, II and III Base Stocks

| Group | Saturates (As determined by ASTM D 2007) Sulfur (As determined by ASTM D 2270) | Viscosity Index (As determined by ASTM D 4294, ASTM D 4297 or ASTM D 3120) |
|---|---|---|
| I | Less than 90% saturates and/or Greater than to 0.03% sulfur | Greater than or equal to 80 and less than 120 |
| II | Greater than or equal to 90% saturates and less than or equal to 0.03% sulfur | Greater than or equal to 80 and less than 120 |
| III | Greater than or equal to 90% saturates and less than or equal to 0.03% sulfur | Greater than or equal to 120 |

Natural lubricating oils may include animal oils, vegetable oils (e.g., rapeseed oils, castor oils and lard oil), petroleum oils, mineral oils, and oils derived from coal or shale.

Synthetic oils may include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogues and homologues thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers. Tri-alkyl phosphate ester oils such as those exemplified by tri-n-butyl phosphate and tri-iso-butyl phosphate are also suitable for use as base oils.

Silicon-based oils (such as the polyakyl—, polyaryl—, polyalkoxy—, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The base oil may be derived from unrefined, refined, rerefined oils, or mixtures thereof. Unrefined oils are obtained directly from a natural source or synthetic source (e.g., coal, shale, or tar sand bitumen) without further purification or treatment. Examples of unrefined oils include a shale oil obtained directly from a retorting operation, a petroleum oil obtained directly from distillation, or an ester oil obtained directly from an esterification process, each of which may then be used without further treatment. Refined oils are similar to the unrefined oils except that refined oils have been treated in one or more purification steps to improve one or more properties. Suitable purification techniques include distillation, hydrocracking, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and often are additionally processed by techniques for removal of spent additives and oil breakdown products.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

It is preferred to use a major amount of base oil in the lubricating oil of this invention. A major amount of base oil as defined herein comprises 40 wt. % or more. Preferred amounts of base oil comprise about 40 wt. % to about 97 wt. % of at least one of Group II, III and IV base oil or preferably greater than about 50 wt. % to about 97 wt. % of at least one of Group II, III and IV base oil or more preferably about 60 wt. % to about 97 wt. % of at least one of Group II, III and IV base oil. (When wt. % is used herein, it is referring to wt. % of the lubricating oil unless otherwise specified.) A more preferred embodiment of this invention may comprise an amount of base oil that comprises about 85 wt. % to about 95 wt. % of the lubricating oil.

OXYMOLYBDENUM COMPLEX

The unsulfurized or sulfurized oxymolybdenum-containing composition employed in the present invention may be generally characterized as a oxymolybdenum complex of a basic nitrogen compound. Such molybdenum/ sulfur complexes are known in the art and are described, for example, in U.S. Pat. No. 4,263,152 to King et al., the disclosure of which is hereby incorporated by reference.

The structure of the molybdenum compositions employed in this invention are not known with certainty; however, they are believed to be compounds in which molybdenum, whose valences are satisfied with atoms of oxygen or sulfur, is either complexed by, or the salt of, one or more nitrogen atoms of the basic nitrogen containing compound used in the preparation of these compositions.

The molybdenum compounds used to prepare the oxymolybdenum and oxymolybdenum/sulfur complexes employed in this invention are acidic molybdenum compounds. By acidic is meant that the molybdenum compounds will react with a basic nitrogen compound as measured by ASTM test D-664 or D-2896 titration procedure. Typically these molybdenum compounds are hexavalent and are represented by the following compositions: molybdic acid, ammonium molybdate, sodium molybdate, potassium molybdate and other alkaline metal molybdates and other molybdenum salts such as hydrogen salts, e.g., hydrogen sodium molybdate, $MoOCl_4$, $MoO_2Br_2$, $Mo_2O_3Cl_6$, molybdenum trioxide or similar acidic molybdenum compounds. Preferred acidic molybdenum compounds are molybdic acid, ammonium molybdate, and alkali metal molybdates. Particularly preferred are molybdic acid and ammonium molybdate.

The basic nitrogen compound used to prepare the oxymolybdenum complexes have at least one basic nitrogen and are preferably oil-soluble. Typical examples of such compositions are succinimides, carboxylic acid amides, hydrocarbyl monoamines, hydrocarbon polyamines, Mannich bases, phosphoramides, thiophosphoramides, phosphonamides, dispersant viscosity index improvers, and mixtures thereof. Any of the nitrogen-containing compositions may be after-treated with, e.g., boron, using procedures well known in the art so long as the compositions continue to contain basic nitrogen. These after-treatments are particularly applicable to succinimides and Mannich base compositions.

The mono and polysuccinimides that can be used to prepare the molybdenum complexes described herein are disclosed in numerous references and are well known in the art. Certain fundamental types of succinimides and the related materials encompassed by the term of art "succinimide" are taught in U.S. Pat. Nos. 3,219,666; 3,172,892; and 3,272,746, the disclosures of which are hereby incorporated by reference. The term "succinimide" is understood in the art to include many of the amide, imide, and amidine species which may also be formed. The predominant product however is a succinimide and this term has been generally accepted as meaning the product of a reaction of an alkenyl substituted succinic acid or anhydride with a nitrogen-containing compound. Preferred succinimides, because of their commercial availability, are those succinimides prepared from a hydrocarbyl succinic anhydride, wherein the hydrocarbyl group contains from about 24 to about 350 carbon atoms, and an ethylene amine, said ethylene amines being especially characterized by ethylene diamine, diethylene triamine, triethylene tetramine, and tetraethylene pentamine. Particularly preferred are those succinimides prepared from polyisobutenyl succinic anhydride of 70 to 128 carbon atoms and tetraethylene pentamine or triethylene tetramine or mixtures thereof.

Also included within the term "succinimide" are the cooligomers of a hydrocarbyl succinic acid or anhydride and a poly secondary amine containing at least one tertiary amino nitrogen in addition to two or more secondary amino groups. Ordinarily this composition has between 1,500 and 50,000 average molecular weight. A typical compound would be that prepared by reacting polyisobutenyl succinic anhydride and ethylene dipiperazine.

Carboxylic acid amide compositions are also suitable starting materials for preparing the oxymolybdenum complexes employed in this invention. Typical of such compounds are those disclosed in U.S. Pat. No. 3,405,064, the disclosure of which is hereby incorporated by reference. These compositions are ordinarily prepared by reacting a carboxylic acid or anhydride or ester thereof, having at least 12 to about 350 aliphatic carbon atoms in the principal aliphatic chain and, if desired, having sufficient pendant aliphatic groups to render the molecule oil soluble with an amine or a hydrocarbyl polyamine, such as an ethylene amine, to give a mono or polycarboxylic acid amide. Preferred are those amides prepared from (1) a carboxylic acid of the formula R'COOH, where R' is $C_{12-20}$ alkyl or a mixture of this acid with a polyisobutenyl carboxylic acid in which the polyisobutenyl group contains from 72 to 128 carbon atoms and (2) an ethylene amine, especially triethylene tetramine or tetraethylene pentamine or mixtures thereof.

Another class of compounds which are useful in this invention are hydrocarbyl monoamines and hydrocarbyl polyamines, preferably of the type disclosed in U.S. Pat. No. 3,574,576, the disclosure of which is hereby incorporated by reference. The hydrocarbyl group, which is preferably alkyl, or olefinic having one or two sites of unsaturation, usually contains from 9 to 350, preferably from 20 to 200 carbon atoms. Particularly preferred hydrocarbyl polyamines are those which are derived, e.g., by reacting polyisobutenyl chloride and a polyalkylene polyamine, such as an ethylene amine, e.g., ethylene diamine, diethylene triamine, tetraethylene pentamine, 2-aminoethylpiperazine, 1,3-propylene diamine, 1,2-propylenediamine, and the like.

Another class of compounds useful for supplying basic nitrogen are the Mannich base compositions.-These compositions are prepared from a phenol or $C_{9-200}$ alkylphenol, an aldehyde, such as formaldehyde or formaldehyde precursor such as paraformaldehyde, and an amine compound. The amine may be a mono or polyamine and typical compositions are prepared from an alkylamine, such as methylamine or an ethylene amine, such as, diethylene triamine, or tetraethylene pentamine, and the like. The phenolic material may be sulfurized and preferably is dodecylphenol or a $C_{80-100}$ alkylphenol. Typical Mannich bases which can be used in this invention are disclosed in U.S. Pat. Nos. 4,157,309 and 3,649,229; 3,368,972; and 3,539,663, the disclosures of which are hereby incorporated by reference. The last referenced patent discloses Mannich bases prepared by reacting an alkylphenol having at least 50 carbon atoms, preferably 50 to 200 carbon atoms with formaldehyde and an alkylene polyamine $HN(ANH)_nH$ where A is a saturated divalent alkyl hydrocarbon of 2 to 6 carbon atoms and n is 1–10 and where the condensation product of said alkylene polyamine may be further reacted with urea or thiourea. The utility of these Mannich bases as starting materials for preparing lubricating oil additives can often be significantly improved by treating the Mannich base using conventional techniques to introduce boron into the composition.

Another class of composition useful for preparing the oxymolybdenum complexes employed in this invention are the phosphoramides and phosphonamides such as those disclosed in U.S. Pat. Nos. 3,909,430 and 3,968,157, the disclosures of which are hereby incorporated by reference. These compositions may be prepared by forming a phosphorus compound having at least one P-N bond. They can be prepared, for example, by reacting phosphorus oxychloride with a hydrocarbyl diol in the presence of a monoamine or by reacting phosphorus oxychloride with a difunctional secondary amine and a mono-functional amine. Thiophosphoramides can be prepared by reacting an unsaturated hydrocarbon compound containing from 2 to 450 or more carbon atoms, such as polyethylene, polyisobutylene, polypropylene, ethylene, 1-hexene, 1,3-hexadiene, isobutylene, 4-methyl-1-pentene, and the like, with phosphorus pentasulfide and a nitrogen-containing compound as defined above, particularly an alkylamine, alkyldiamine, alkylpolyamine, or an alkyleneamine, such as ethylene diamine, diethylenetriamine, triethylenetetramine, tetraethylenepentamine, and the like.

Another class of nitrogen-containing compositions useful in preparing the molybdenum complexes employed in this invention includes the so-called dispersant viscosity index improvers (VI improvers). These VI improvers are commonly prepared by functionalizing a hydrocarbon polymer, especially a polymer derived from ethylene and/or propylene, optionally containing additional units derived from one or more co-monomers such as alicyclic or aliphatic olefins or diolefins. The functionalization may be carried out by a variety of processes which introduce a reactive site or sites which usually has at least one oxygen atom on the polymer. The polymer is then contacted with a nitrogen-containing source to introduce nitrogen-containing functional groups on the polymer backbone. Commonly used nitrogen sources include any basic nitrogen compound especially those nitrogen-containing compounds and compositions described herein. Preferred nitrogen sources are alkylene amines, such as ethylene amines, alkyl amines, and Mannich bases.

Preferred basic nitrogen compounds for use in this invention are succinimides, carboxylic acid amides, and Mannich bases. More preferred are succinimides having an average molecular weight of 1000 or 1300 or 2300 and mixtures thereof. Such succinimides can be post treated with boron or ethylene carbonate as known in the art.

The oxymolybdenum complexes of this invention can also be sulfurized. Representative sulfur sources for preparing the oxymolybdenum/sulfur complexes used in this invention are sulfur, hydrogen sulfide, sulfur monochloride, sulfur dichloride, phosphorus pentasulfide, $R''_2S_x$ where R" is hydrocarbyl, preferably $C_{1-40}$ alkyl, and x is at least 2, inorganic sulfides and polysulfides such as $(NH_4)_2Sy$, where y is at least 1, thioacetamide, thiourea, and mercaptans of the formula R"SH where R" is as defined above. Also useful as sulfurizing agents are traditional sulfur-containing antioxidants such as wax sulfides and polysulfides, sulfurized olefins, sulfurized carboxylic and esters and sulfurized ester-olefins, and sulfurized alkylphenols and the metal salts thereof.

The sulfurized fatty acid esters are prepared by reacting sulfur, sulfur monochloride, and/or sulfur dichloride with an unsaturated fatty ester under elevated temperatures. Typical esters include $C_1$–$C_{20}$ alkyl esters of $C_8$–$C_{24}$ unsaturated fatty acids, such as palmitoleic, oleic, ricinoleic, petroselinic, vaccenic, linoleic, linolenic, oleostearic, licanic, paranaric, tariric, gadoleic, arachidonic, cetoleic, etc. Particularly good results have been obtained with mixed unsaturated fatty acid esters, such as are obtained from animal fats and vegetable oils, such as tall oil, linseed oil, olive oil, caster oil, peanut oil, rape oil, fish oil, sperm oil, and so forth.

Exemplary fatty esters include lauryl tallate, methyl oleate, ethyl oleate, lauryl oleate, cetyl oleate, cetyl linoleate, lauryl ricinoleate, oleyl linoleate, oleyl stearate, and alkyl glycerides.

Cross-sulfurized ester olefins, such as a sulfurized mixture of $C_{10-25}$ olefins with fatty acid esters of $C_{10}$–$C_{25}$ fatty acids and $C_{10-25}$ alkyl or alkenyl alcohols, wherein the fatty acid and/or the alcohol is unsaturated may also be used.

Sulfurized olefins are prepared by the reaction of the $C_3$–$C_6$ olefin or a low-molecular-weight polyolefin derived therefrom with a sulfur-containing compound such as sulfur, sulfur monochloride, and/or sulfur dichloride.

Also useful are the aromatic and alkyl sulfides, such as dibenzyl sulfide, dixylyl sulfide, dicetyl sulfide, diparaffin wax sulfide and polysulfide, cracked wax-olefin sulfides and so forth. They can be prepared by treating the starting material, e.g., olefinically unsaturated compounds, with sulfur, sulfur monochloride, and sulfur dichloride. Particularly preferred are the paraffin wax thiomers described in U.S. Pat. No. 2,346,156.

Sulfurized alkyl phenols and the metal salts thereof include compositions such as sulfurized dodecylphenol and the calcium salts thereof. The alkyl group ordinarily contains from 9–300 carbon atoms. The metal salt may be preferably, a Group I or Group II salt, especially sodium, calcium, magnesium, or barium.

Preferred sulfur sources are sulfur, hydrogen sulfide, phosphorus pentasulfide, $R'''_2Sz$ where R''' is hydrocarbyl, preferably $C_1$–$C_{10}$ alkyl, and z is at least 3, mercaptans wherein R''' is $C_1$–$C_{10}$ alkyl, inorganic sulfides and polysulfides, thioacetamide, and thiourea. Most preferred sulfur sources are sulfur, hydrogen sulfide, phosphorus pentasulfide, and inorganic sulfides and polysulfides.

The polar promoter used in the preparation of the molybdenum complexes employed in this invention is one which facilitates the interaction between the acidic molybdenum compound and the basic nitrogen compound. A wide variety of such promoters are well known to those skilled in the art. Typical promoters are 1,3-propanediol, 1,4-butane-diol, diethylene glycol, butyl cellosolve, propylene glycol, 1,4-butyleneglycol, methyl carbitol, ethanolamine, diethanolamine, N-methyl-diethanol-amine, dimethyl formamide, N-methyl acetamide, dimethyl acetamide, methanol, ethylene glycol, dimethyl sulfoxide, hexamethyl phosphoramide, tetrahydrofuran and water. Preferred are water and ethylene glycol. Particularly preferred is water.

While ordinarily the polar promoter is separately added to the reaction mixture, it may also be present, particularly in the case of water, as a component of non-anhydrous starting materials or as waters of hydration in the acidic molybdenum compound, such as $(NH4)_6Mo_7O_{24}\cdot H_2O$. Water may also be added as ammonium hydroxide.

A method for preparing the oxymolybdenum complexes used in this invention is to prepare a solution of the acidic molybdenum precursor and a polar promoter with a basic nitrogen-containing compound with or without diluent. The diluent is used, if necessary, to provide a suitable viscosity for easy stirring. Typical diluents are lubricating oil and liquid compounds containing only carbon and hydrogen. If desired, ammonium hydroxide may also be added to the reaction mixture to provide a solution of ammonium molybdate. This reaction is carried out at a variety of temperatures, typically at or below the melting point of the mixture to reflux temperature. It is ordinarily carried out at atmospheric pressure although higher or lower pressures may be used if desired. This reaction mixture may optionally be treated with a sulfur source as defined above at a suitable pressure and temperature for the sulfur source to react with the acidic molybdenum and basic nitrogen compounds. In some cases, removal of water from the reaction mixture may be desirable prior to completion of reaction with the sulfur source.

In a preferred and improved method for preparing the oxymolybdenum complexes, the reactor is agitated and heated at a temperature less than or equal to about 120 degrees Celsius, preferably from about 70 degrees Celsius to about 90 degrees Celsius. Molybdic oxide or other suitable molybdenum source is then charged to the reactor and the temperature is maintained at a temperature less than or equal to about 120 degrees Celsius, preferably at about 70 degrees Celsius to about 90 degrees Celsius, until the molybdenum is sufficiently reacted. Excess water is removed from the reaction mixture. Removal methods include but are not limited to vacuum distillation or nitrogen stripping while maintaining the temperature of the reactor at a temperature less than or equal to about 120 degrees Celsius, preferably between about 70 degrees Celsius to about 90 degrees Celsius. The temperature during the stripping process is held at a temperature less than or equal to about 120 degrees Celsius to maintain the low color intensity of the molybdenum-containing composition. It is ordinarily carried out at atmospheric pressure although higher or lower pressures may be used. The stripping step is typically carried out for a period of about 0.5 to about 5 hours.

If desired, this product can be sulfurized by treating this reaction mixture with a sulfur source as defined above at a suitable pressure and temperature, not to exceed about 120 degrees Celsius for the sulfur source to react with the acidic molybdenum and basic nitrogen compounds. The sulfurization step is typically carried out for a period of from about 0.5 to about 5 hours and preferably from about 0.5 to about 2 hours. In some cases, removal of the polar promoter (water) from the reaction mixture may be desirable prior to completion of reaction with the sulfur source. The oxymolybdenum complex and oxymolybdenum/sulfur complex produced by such method is lighter in color (when compared to complexes prepared at higher temperatures) while maintaining good fuel economy, excellent oxidation inhibition, and anti-wear performance qualities. Color in this instance can be more visibly or more quantifiably using a UV spectrophotometer such as a Perkin-Elmer Lambda 18 UV-Visible Double-Beam Spectrophotometer. As used herein, this test recorded the visible spectra of molybdenum compositions at a constant concentration in an isooctane solvent. The spectra represent the absorbance intensity plotted versus the wavelength in nanometers. The spectra extend from the visible region into the near infrared region of the electromagnetic radiation (350 nanometers to 900 nanometers). In this test, the highly colored samples showed increasingly higher absorbance at increasingly higher wavelengths at a constant molybdenum concentration. The preparation of the sample for color measurement comprises diluting the molybdenum-containing composition with isooctane to achieve a constant molybdenum concentration of 0.00025 g molybdenum per gram of the molybdenum-containing composition/isooctane mixture. Prior to sample measurement the spectrophotometer is referenced by scanning air versus air. The UV visible spectrum from 350 nanometers to 900 nanometers is obtained using a one centimeter path-length quartz cell versus an air reference. The spectra are offset corrected by setting the 867 nanometer absorbance to zero. Then the absorbance of the sample is determined at 350 nanometers wavelength.

Characteristics of these new oxymolybdenum/sulfur complexes are disclosed in U.S. patent application Ser. No. 10/159,446 filed May 31, 2002, entitled REDUCED COLOR MOLYBDENUM-CONTAINING COMPITION AND A METHOD OF MAKING SAME, incorporated herein by reference in its entirety.

In the reaction mixture, the ratio of molybdenum compound to basic nitrogen compound is not critical; however, as the amount of molybdenum with respect to basic nitrogen increases, the filtration of the product becomes more difficult. Since the molybdenum component probably oligomerizes, it is advantageous to add as much molybdenum as can easily be maintained in the composition. Usually, the reaction mixture will have charged to it from 0.01 to 2.00 atoms of molybdenum per basic nitrogen atom. Preferably from 0.3 to 1.0, and most preferably from 0.4 to 0.7, atoms of molybdenum per atom of basic nitrogen is added to the reaction mixture.

When optionally sulfurized, the sulfurized oxymolybdenum containing compositions may be generally characterized as a sulfur/molybdenum complex of a basic nitrogen dispersant compound preferably with a sulfur to molybdenum weight ratio of about (0.01 to 1.0) to 1 and more preferably from about (0.05 to 0.5) to 1 and a nitrogen to molybdenum weight ratio of about (1 to 10) to 1 and more preferably from (2 to 5) to 1. For extremely low sulfur incorporation the sulfur to molybdenum weight ratio can be from (0.01 to 0.08) to 1.

The sulfurized and unsulfurized oxymolybdenum complexes of this invention are typically employed in a lubricating oil in an amount of 0.01 to 10 %, more preferably from 0.04 to 1 wt %.

SULFURIZED OXYMOLYBDENUM DITHIOCARBAMATE

The sulfurized oxymolybdenum dithiocarbamate employed in the lubricating composition is represented by the formula (1).

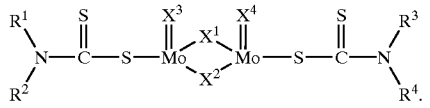

In the formula (1), $R^1$ to $R^4$ are independently selected from a hydrocarbon group or can be the same hydrocarbyl group of suitable length to provide oil solubility. Hydrocarbon groups include, but are not limited to, alkyl groups, alkenyl groups, aryl groups, cycloalkyl groups and cycloalkenyl groups.

Examples of the alkyl groups include methyl, ethyl, propyl, isopropyl, butyl, isobutyl, secondary butyl, tertiary butyl, pentyl, isopentyl, secondary pentyl, neopentyl, tertiary pentyl, hexyl, secondary hexyl, heptyl, secondary heptyl, octyl, 2-ethylhexyl, secondary octyl, nonyl, secondary nonyl, decyl, secondary decyl, undecyl, secondary undecyl, dodecyl, secondary dodecyl, tridecyl, isotridecyl, secondary tridecyl, tetradecyl, secondary tetradecyl, hexadecyl, secondary hexadecyl, stearyl, icosyl, docosyl, tetracosyl, triacontyl, 2-butyloctyl, 2-butyldecyl, 2-hexyloctyl, 2-hexyldecyl, 2-octyldecyl, 2-hexyldodecyl, 2-octyldodecyl, 2-decyltetradecyl, 2-dodecylhexadecyl, 2-hexadecyloctadecyl, 2-tetradecyloctadecyl, monomethyl branched-isostearyl and the like.

The alkenyl groups include, but are not limited to, vinyl, allyl, propenyl, butenyl, isobutenyl, pentenyl, isopentenyl, hexenyl, heptenyl, octenyl, nonenyl, decenyl, undecenyl, dodecenyl, tetradecenyl, oleyl and the like.

As the aryl groups, there may be mentioned, for instance, phenyl, toluyl, xylyl, cumenyl, mesityl, benzyl, phenethyl, styryl, cinnamyl, benzhydryl, trityl, ethylphenyl, propylphenyl, butylphenyl, pentylphenyl, hexylphenyl, heptylphenyl, octylphenyl, nonylphenyl, decylphenyl, undecylphenyl, dodecylphenyl, phenylphenyl, benzylphenyl, styrenated phenyl, p-cumylphenyl, alpha-naphthyl, beta-naphthyl groups and the like.

The cycloalkyl groups and cycloalkenyl groups include, but are not limited to, cyclopentyl, cyclohexyl, cycloheptyl, methylcyclopentyl, methylcyclohexyl, methylcycloheptyl, cyclopentenyl, cyclohexenyl, cycloheptenyl, methylcyclopentenyl, methylcyclohexenyl, methylcycloheptenyl groups and the like.

Of these groups, the alkyl groups or alkenyl groups are preferred as $R^1$ to $R^4$. More preferred are alkyl groups having 4 to 18 carbon atoms, preferably a branched alkyl group having 6 to 13 carbon atoms. Preferably the R groups are identical groups.

In another aspect $R^1$ to $R^4$ are independently selected hydrocarbon groups, preferably $R^1$ and $R^2$ are the same hydrocarbon but different than $R^3$ and $R^4$ which may be the same hydrocarbon group. More preferably, $R^1$ and $R^2$ are each an alkyl group having 6 to 10 carbon atoms, and $R^3$ and $R^4$ are each an alkyl group having 11 to 18 carbon atoms, and most preferably, $R^1$ and $R^2$ are each a branched alkyl group having 6 to 10 carbon atoms, and $R^3$ and $R^4$are each a branched alkyl group having 11 to 18 carbon atoms.

In the formula (1), $X^1$ to $X^4$ are independently selected from sulfur or oxygen atom, and all of $X^1$ to $X^4$ may be a sulfur atom or an oxygen atom, or a mixture of a sulfur atoms and oxygen atoms. In consideration of balance between friction reducing effect and corrosivity, the molar ratio (ratio of numbers) of sulfuric atom(s)/oxygen atom(s) should particularly preferably be in the range from 1/3 to 3/1. Some of the oil-soluble molybdenum compounds of Formula I are commercially available. For example products where $X^1$ and $X^2$ are O,$X^3$ and $X^4$ are S, and where $R^1$ to $R^4$ are $C_{13}H_{27}$ aliphatic hydrocarbyl groups and where the molybdenum is in oxidation state V are sold under the trademarks Molyvan 807 and Molyvan 822 as antioxidants and friction reducing additives by R. T. Vanderbilt Company Inc. Norwalk Conn. USA. These molybdenum compounds may be prepared by the methods described in U.S. Pat. No. 3,356,702 wherein $MoO_3$ is converted to soluble molybdate by dissolving in alkali metal hydroxide solution, neutralized by the addition of acid followed by the addition of a secondary amine and carbon disulfide. In another aspect, the molybdenum compounds of general structure I wherein $X^1$ to $X^4$ are O or S may be prepared by a number of methods known in the art, for example U.S. Pat. No. 4,098,705 and 5,631,213. JP 51080825 (Asahi Denka Kogyo K. K.) discloses a method wherein $MoS_3$, secondary amine and $CS_2$ are reacted together in an inert organic solvent. Bull. Jap. Petrol. Inst. 1971, 13(2), 243–9 discloses a method wherein sulfurized molybdenum dialkyl-dithiocarbamates are treated in xylene solution with $P_2$ S5 with heating followed by the dissolving in DMF of the resulting precipitate with further heating. Preferably the molybdenum complex contains some oxygen atoms, more preferably the ratio of S/O is 2.0/2.0 in $X^1$ to $X^4$ and $R^1$ to $R^4$ is ethylhexyl group or $R^1$ and $R^2$ are 2-ethylhexyl and $R^3$ and $R^4$ are isotridecyl.

The amounts of the sulfurized oxymolybdenum dithiocarbamate, or as sometimes referred to herein as MoDTC, is particularly limited, if the amounts are excessively small, the friction reducing effect is insufficient, on the contrary, if they are excessively large, sludge or corrosion is liable to occur. Sulfurized oxymolybdenum dithiocarbamates are not believed to exhibit abrasion resistance effects, by themselves, when the amounts are comparatively low, i.e., about 0.03% by weight (300ppm) in terms of molybdenum relative to the lubricating base. As taught in the art, for effective friction reducing effect they are employed at concentration in excess of 0.07 % by weight (700 ppm molybdenum) up to 0.2 % by weight (2000 ppm molybdenum). These compositions exhibit friction reducing effect when the amounts are comparatively large i.e. greater than 1% by weight in terms of molybdenum relative to the weight of the lubricating base; however diminished economic effect of the friction reduction and generation of engine sludge and varnish at these concentrations limit this application. The present invention discloses a synergist coupling of a sulfurized oxymolybdenum nitrogen dispersant and below 175 ppm of a sulfurized oxymolybdenum dithiocarbamate, the total proportion of the sulfurized oxymolybdenum dithiocarbamate is employed at concentrations below 125 ppm and more preferably at or below 100 ppm (about 0.01%) and even more preferably at or below 80 ppm or 0.08% (by weight in terms of molybdenum from the dithiocarbamate relative to the weight of the lubricating base), there is not expected to have any effect below 10 ppm.

The sulfurized oxymolybdenum dithiocarbamates represented by the formula (1) can be prepared by reacting molybdenum trioxide or a molybdate with an alkali sulfide or an alkali hydrosulfide, and subsequently adding carbon disulfide and a secondary amine to the reaction mixture and reacting the resultant mixture at an adequate temperature. To prepare the asymmetric sulfurized oxymolybdenum dithiocarbamates, the use of a secondary amine having different hydrocarbon groups or the use of two or more different secondary amines in the above process is sufficient. The symmetric sulfurized oxymolybdenum dithiocarbamates can also be prepared in a similar manner, but with the use of only one secondary amine.

DETERGENT

The compositions of the present invention may optionally contain a detergent. The use of a detergent, specifically a high overbased (HOB) calcium phenate in combination with the sulfurized organomolybdenum compounds described above lead to further synergy and improved reduction in the friction coefficient. Accordingly, one embodiment of this invention is an additive package for reducing friction comprising an oil of lubricating viscosity, a sulfurized oxymolybdenum nitrogen dispersant, a sulfurized oxymolybdenum dithiocarbamate employed at low concentration and a detergent (preferably a HOB calcium phenate). There are a number of materials that are suitable as detergents for the purpose of this invention. These materials include phenates (high overbased HOB or low overbased LOB), high overbased phenate stearates, phenolates, salicylates, phosphonates, thiophosphonates and sulfonates and mixtures thereof Preferably, phenates are employed, more preferably HOB calcium or magnesium phenates.

As used herein and in the claims the term "phenate" means the broad class of metal phenates including salts of alkylphenols, alkylphenol sulfides, and the alkylphenol-aldehyde condensation products. Detergents formed from the polar phenate substrate may be overbased. Normal phenate has the structural formula: and phenate sulfide has the formula:

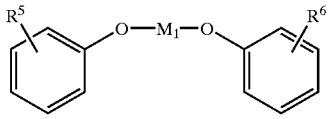

and phenate sulfide has the formula:

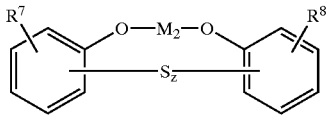

whereas methylene coupled phenate has the structural formula:

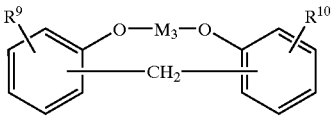

wherein $R^5$ through $R^{10}$ may be the same or different and are each independently selected from straight or branched alkyl groups preferably of eight or more carbon atoms and more preferably $C_9$ to $C_{22}$ alkyl; $M_1$, $M_2$ and $M_3$ are independently and alkaline earth metal (preferably Ca, Ba, Mg), and z can range from 1 to 3 depending on the particular metal involved. The calcium and magnesium phenates are preferred for use in the present invention. Multiple phenate rings may also be formed as opposed to the discrete formulas above.

The materials are generally prepared by carrying out the reaction in a low viscosity mineral oil at temperatures ranging up to 260 degree Celsius depending on the reactivity of the metallic base. The alkylphenol intermediates can be prepared by alkylating phenol with olefins, chlorinated paraffins, or alcohols using catalysts such as $H_2SO_4$ and $AlCl_3$, with the latter being employed with the chlorinated paraffin in a typical Friedel-Crafts type of alkylation. A preferred high overbased sulfurized alkylphenate is prepared by neutralizing a sulfurized alkylphenyl with an alkaline earth base (preferably calcium) in the presence of a dilution oil, an alkyl polyhydric alcohol (preferably ethylene glycol) and halide ions, the glycol being present in the form of a mixture with alcohol, glycol, water and sediment, carbonating the reaction medium with $CO_2$ in the presence of halide ions and again removing alcohol, glycol water, and sediment. The alkylphenate can be treated either before, during, or subsequent to overbasing with a long-chain carboxylic acid (preferably stearic acid), anhydride or salt thereof.

By use of an excess of the metal base over the theoretical amounts required to form the normal phenates, it is possible to form the so-called basic alkaline phenates. Basic alkaline-earth phenates containing two and three times the stoichiometric quantity of metal have been reported in the patent literature.

Since an important function of the alkaline-earth metal phenate is acid neutralization, the incorporation of excess base into these materials provides a distinct advantage over the metal-free phenates. Basic phenates can also be prepared from the phenol sulfides. This imparts the benefits of acid neutralization capacity to the phenol sulfides.

Overbased alkaline-earth metal phenates have been casually defined by the amount of total basicity contained in the product. It has become popular to label a detergent by its TBN (total base number), i.e. a 300 TBN synthetic sulfonate. Base number is defined in terms of the equivalent amount of potassium hydroxide contained in the material. Thus, higher TBN numbers reflect more alkaline products, and therefore a greater alkaline reserve. The TBN of a sample can be determined by ASTM Test No. D2869 or any other equivalent procedure. A 300 TBN calcium sulfonate contains base equivalent to 300 milligrams of potassium hydroxide per gram or, more simply, 300 mg KOH/g. Two factors limit the degree of overbasing: oil solubility and filterability.

The alkaline-earth metal phenates useful in the present invention should have TBN's of from about 40 to 400, preferably 200–400, with 100–300 being more preferred and 140–250 being most preferred. Representative of the commercially available high TBN phenates which are useful in the present invention include: OLOA 216S (5.25% calcium, 3.4% sulfur, 145 TBN); 218A (5.25% calcium, 2.4% sulfur, 147 TBN); 219 (9.25% calcium, 3.3% sulfur, 250 TBN); or 247E (12.5% calcium, 2.4% sulfur, 320 TBN). All of these calcium phenates are available from the Chevron Oronite LLC, Houston Tex. Other representative commercially available calcium phenates include LUBRIZOL 6499 (9.2% calcium, 3.25% sulfur, 250 TBN); 6500 (7.2% calcium, 2.6% sulfur, 200 TBN); or 6501 (6.8% calcium, 2.3% sulfur, 190 TBN). All of these phenates are available from the Lubrizol Corporation of Wickliffe, Ohio. TBN's may be determined using ASTM D 2896.

Although the alkaline-earth metal phenates useful in the present invention fall into the general class of additives known as detergents, the phenates as related to the maximum discovered synergy with the ograno-molybdenum compounds are not interchangeable with other detergents, i.e. sulfonates, as two detergents having the same TBN, molecular weight, metal ratio and the like, will have widely different performance characteristics in the present invention.

When a sulfonate detergent is employed preferably it is an alkali or alkaline earth metal salt of a hydrocarbyl sulfonic acid having from 15 to 200 carbons. Preferably the term "sulfonate" encompasses the salts of sulfonic acid derived from petroleum products. Such acids are well known in the art. They can be obtained by treating petroleum products with sulfuric acid or sulfur trioxide. The acids thus obtained are known as petroleum sulfonic acids and the salts as petroleum sulfonates. Most of the petroleum products which become sulfonated contain an oil-solubilizing hydrocarbon group. Also included within the meaning of "sulfonate" are the salts of sulfonic acids of synthetic alkyl aryl compounds. These acids also are prepared by treating an alkyl aryl compound with sulfuric acid or sulfur trioxide. At least one alkyl substituent of the aryl ring is an oil-solubilizing group, as discussed above. The acids thus obtained are known as alkyl aryl sulfonic acids and the salts as alkyl aryl sulfonates. The sulfonates where the alkyl is straight-chain are the well-known linear alkylaryl sulfonates.

The acids obtained by sulfonation are converted to the metal salts by neutralizing with a basic reacting alkali or alkaline earth metal compound to yield the Group I or Group II metal sulfonates. Generally, the acids are neutralized with an alkali metal base. Alkaline earth metal salts are obtained from the alkali metal salt by metathesis. Alternatively, the sulfonic acids can be neutralized directly with an alkaline earth metal base. The sulfonates can then be overbased, although, for purposes of this invention, overbasing is not necessary. Overbased materials and methods of preparing such materials are well known to those skilled in the art. See, for example, LeSuer U.S. Pat. No. 3,496,105.

Particularly preferred, however, because of their wide availability, are salts of the petroleum sulfonic acids, particularly the petroleum sulfonic acids which are obtained by sulfonating various hydrocarbon fractions such as lubricating oil fractions and extracts rich in aromatics which are obtained by extracting a hydrocarbon oil with a selective solvent, which extracts may, if desired, be alkylated before sulfonation by reacting them with olefins or alkyl chlorides by means of an alkylation catalyst; organic polysulfonic acids such as benzene disulfonic acid which may or may not be alkylated; and the like.

The preferred salts for use in the present invention are those of alkylated aromatic sulfonic acids in which the alkyl radical or radicals contain at least about 8 carbon atoms, for example from about 8 to 22 carbon atoms. Another preferred group of sulfonate starting materials are the aliphatic-substituted cyclic sulfonic acids in which the aliphatic substituents or substituents contain a total of at least 12 carbon atoms, such as the alkyl aryl sulfonic acids, alkyl cycloaliphatic sulfonic acids, the alkyl heterocyclic sulfonic acids and aliphatic sulfonic acids in which the aliphatic radical or radicals contain a total of at least 12 carbon atoms. Specific examples of these oil-soluble sulfonic acids include petroleum sulfonic acid, petrolatum sulfonic acids, mono- and poly-wax-substituted naphthalene sulfonic acids, substituted sulfonic acids, such as cetyl benzene sulfonic acids, cetyl phenyl sulfonic acids, and the like, aliphatic sulfonic acid, such as paraffin wax sulfonic acids, hydroxy-substituted paraffin wax sulfonic acids, etc., cycloaliphatic sulfonic acids, petroleum naphthalene sulfonic acids, cetyl cyclopentyl sulfonic acid, mono- and poly-wax-substituted cyclohexyl sulfonic acids, and the like. The term "petroleum sulfonic acids" is intended to cover all sulfonic acids that are derived directly from petroleum products.

Typical Group II metal sulfonates suitable for use in this composition include the metal sulfonates exemplified as follows: calcium white oil benzene sulfonate, barium white oil benzene sulfonate, magnesium white oil benzene sulfonate, calcium dipolypropene benzene sulfonate, barium dipolypropene benzene sulfonate, magnesium dipolypropene benzene sulfonate, calcium mahogany petroleum sulfonate, barium mahogany petroleum sulfonate, magnesium mahogany petroleum sulfonate, calcium triacontyl sulfonate, magnesium triacontyl sulfonate, calcium lauryl sulfonate, barium lauryl sulfonate, magnesium lauryl sulfonate, etc.

OTHER ADDITIVES

Other additives can be employed in the present invention which include ashless dithiocarbamates that are preferably soluble in the lubrication oil package. The term ashless refers to compounds that are essentially metal free. Examples of ashless dithiocarbamates that may be used include, but are not limited to, methylenebis (dialkyldithiocarbamate), ethylenebis (dialkyldithiocarbamate), and isobutyl disulfide-2,2'-bis (dialkyldithiocarbamate), where the alkyl groups of the dialkyldithiocarbamate can preferably have from 1 to 16 carbons. Examples of preferred ashless dithiocarbamates are methylenebis (dibutyldithiocarbamate), ethylenebis (dibutyldithiocarbamate), and isobutyl disulfide-2,2'-bis (dibutyldithiocarbamate). Other additives such as may be added to the formulated oil package of this invention such as those described herein above to prepare the oxymolybdenum complex. These additives can also include viscosity-index improvers including conjugated diolefin block copolymers and low molecular weight methacrylate polymers, dispersants (of the ash and/or ashless type as described herein above), pour point depressants such as acrylate and methacrylate polymers, antioxidants, metal passivators, anti-foam agents (such as alkyl methacrylate polymers and dimethyl silicone polymers), and anti-corrosion agents. If desired, in addition to the present load-bearing additives, the lubricating composition may include other compounds having a load-bearing action such as extreme pressure agents (EP agents): zinc dialkyldithiophosphate (primary alkyl type & secondary alkyl type or mixtures thereof), preferably secondary type, employed at concentrations less than 0.5 wt % phosphorous based upon the lubricating composition more preferably employed at low concentrations of 0.07 wt % phosphorous and more preferably at or below 0.05 wt % phosphorous based upon the lubricating composition. Phosphorous is known in the art to poison catalysts therefore low total phosphorous containing lubricants are preferred wherein the total phosphorous in the lubricating composition is below about 0.07 wt % phosphorous and more preferably at or below 0.05 wt % phosphorous based upon the lubricating composition. Sulfurized oils, diphenyl sulfide, methyl trichlorostearate, chlorinated naphthalene, and fluoroalkylpolysiloxane can be employed.

Oxidation inhibitors include: phenol type oxidation inhibitors: 4,4'-methylene bis (2,6-di-tert-butylphenol), 4,4'-bis(2,6-di-tert-butylphenol), 4,4'-bis(2-methyl-6-tert-butylphenol), 2,2'-methylene bis (4-methyl-6-tert-butylphenol), 4,4'-butylidenebis (3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis (4-methyl-6-cyclohexylphenol), 2,6-di-tert-butyl-4-methyl-phenol, 2,6-di-tert-butyl-4-ethylphenol, 2,4-dimethyl-6-tert-butylphenol, 2,6-di-tert-4-(N.N'dimethylaminomethylphenol), 4,4'-thiobis (2-methyl-6-tert-butylphenol), 2,2'-thiobis(4-methyl-6-tert-butylphenol), bis (3-methyl-4-hydroxy-5-tert-butylbenzyl)-sulfide, and bis (3,5-di-tert-butyl-4-hydroxybenzyl). Diphenylamine type oxidation inhibitor: alkylated diphenylamine or naphthylamine and phenyl-alpha-naphthylamine. Demulsifiers: addition product of alkylphenol and ethyleneoxide, poloxyethylene alkyl ether, and polyoxyethylene sorbitan ester.

Viscosity index improvers include: polymethacrylate type polymers, ethylene-propylene copolymers, styrene-isoprene copolymers, hydrogenated styrene-isoprene copolymers, polyisobutylene, and dispersant type viscosity index improvers.

EXAMPLES

The invention is further illustrated by the following examples which are not to be considered as limitative of its scope.

The optionally sulfurized oxymolybdenum nitrogen dispersant complex of this invention was measured for absorbance intensity at a wavelength of 350 nanometers in a one centimeter path-length quartz cell in a UV-Visible spectrophotometer by diluting the molybdenum containing composition with isooctane to a constant molybdenum concentration of 0.00025 grams of molybdenum per gram of the diluted molybdenum containing composition. Light color of the component was determined for absorbance intensity of less than 0.07.

The following examples A and B illustrate the process of making a optionally sulfurized oxymolybdenum complex was carried out at a high temperature (greater than 120° C.) during the molybdation reaction, stripping and/or sulfurization steps. This procedure follows the process according to King, U.S. Pat. No. 4,263,152. Both Example A and B employed a 1-L, three-necked, round-bottomed glass flask, fitted with a mechanical stirrer, a heating mantle, temperature probe for controlling and measuring the temperature, and water-cooled condenser, were charged 269.3 grams of mono-succinimide dispersant (950 MW, 2.07% N), 25.2 grams of molybdic oxide, 43 grams of water, and 135 grams of Chevron 350 H thinner, which is a hydrocarbon thinner.

Example A: The reaction mixture was heated while stirring at reflux (about 100° C.) for 2 hours. The flask was fitted with a Dean-Stark trap and the reaction mixture was heated to 170° C. for 2 hours, recovering about 40 grams of water. The product was filtered over Celite at about 150° C., and half the filtrate was stripped at 170° C. under house vacuum to remove the solvent for about 1.5 hours. Analysis showed a molybdenum content of 6.0% by weight, a sulfur content of 0.7% which is attributed to sulfur in the base oil, and a color of 3.ODDD using ASTM D1500. This product had an absorbance intensity of greater than 1.5 at a wavelength of 350 nanometers.

Example B: Sulfurization: To the second half of the filtrate of Example A was added elemental sulfur, sufficient to give a Charge Mole Ratio (CMR) (S/Mo) of 1/2. After reacting at 170° C. for 4 hours, the solvent was stripped at 170° C. under house vacuum for 1 hour. Analysis gave a molybdenum content of 6.0% by weight, a sulfur content of 2.6% by weight, nitrogen content of 1.9% by weight, and a color of 4.5 DDD using ASTM D1500 having an absorbance intensity of greater than 1.5 at a wavelength of 350 nanometers.

Examples C through H were undertaken while maintaining reaction temperatures at low temperatures (at or below 120° C.) during the molybdation reaction, stripping and/or sulfurization steps.

Example C: 250 grams of a bissuccinimide, prepared from a polyisobutenyl (1000 M.W.) succinic anhydride (PIBSA) and a mixture of polyethylene polyamine oligomers available as E-100 polyethyleneamine from Huntsman Chemical Company at a molar ratio of amine to PIBSA of 0.5 to 1, and 162.5 grams of neutral oil were charged to a glass reactor equipped with a temperature controller, mechanical stirrer, and water cooled condenser. The mixture was heated to a molybdation reaction temperature of 70° C. While at reaction temperature, 26.6 grams of molybdenum oxide and 45.8 grams of water were charged to the reactor. The reactor was then held at a reaction temperature of 70° C. for 28 hours. Upon completion of the molybdation reaction, water was removed by distillation that was carried out at temperature 99° C. and a pressure of 25 millimeters of mercury (absolute) or less for approximately 30 minutes. The product contained 4.01 % by weight of molybdenum and 1.98% by weight of nitrogen and an absorbance intensity of about 0.495 at a wavelength of 350 nanometers.

Example D: 384.4 grams of bissuccinimide as prepared in Example C and 249.0 grams of neutral oil were charged to a glass reactor equipped with a temperature controller, mechanical stirrer, and water cooled condenser. The mixture was heated to molybdation reaction temperature 70° C. While at reaction temperature, 40.9 grams of molybdenum oxide and 70.4 grams of water were charged to the reactor. The reactor was then held at reaction temperature 70° C. for 18 hours. Upon completion of the molybdation reaction, water was removed by distillation that was carried out at temperature 99° C. and a pressure of 25 millimeters of mercury (absolute) or less for approximately 30 minutes. At a later time, an 18.7 gram sample of this product was charged to a 250 ml round-bottomed flask. 0.007 grams of sulfur were also charged to the flask. The reaction mixture was then heated to a sulfurization temperature of 80° C. The sulfurization reaction was carried out for 0.5 hours. The product contained 2.03% by weight of nitrogen and 3.83% by weight of molybdenum and an absorbance intensity of about 0.644 at a wavelength of 350 nanometers.

Example E: 299.0 grams of a monosuccinimide, prepared from a polyisobutenyl (1000 M.W.) succinic anhydride (PIBSA) and a mixture of diethylene triamine (DETA) and E-100 polyethyleneamine at a molar ratio of amine to PIBSA of 0.65 to 1, and 232.1 grams of neutral oil were charged to a glass reactor equipped with a temperature controller, mechanical stirrer, and water cooled condenser. The mixture was heated to a molybdation reaction temperature of 70° C. While at reaction temperature, 34.3 grams of molybdenum oxide and 58.9 grams of water were charged to the reactor. The reactor was then held at reaction temperature 70° C. for 21 hours. Upon completion of the molybdation reaction, water was removed by distillation that was carried out at temperature 99° C. and a pressure of 25 millimeters of mercury (absolute) or less for approximately 30 minutes. The product contained 1.92% by weight of nitrogen and 4.08% by weight molybdenum and an absorbance intensity of about 0.315 at a wavelength of 350 nanometers.

Example F: 321.4 grams of monosuccinimide as prepared in Example 3 and 51.0 grams of neutral oil were charged to a glass reactor equipped with a temperature controller, mechanical stirrer, and water cooled condenser. The mixture was heated to molybdation reaction temperature 90° C. While at reaction temperature, 24.0 grams of molybdenum oxide and 41.2 grams of water were charged to the reactor. The reactor was then held at reaction temperature 90° C. for 7 hours. Upon completion of the molybdation reaction, water was removed by distillation that was carried out at temperature 99° C. and a pressure of 25 millimeters of mercury (absolute) or less for approximately 30 minutes. The reaction mixture was then adjusted to the sulfurization temperature 90° C. 0.17 grams of sulfur were charged to the reactor. The sulfurization reaction was carried out for 0.5 hours. The product contained 3.15% by weight nitrogen, 4.06% by weight molybdenum, and 0.21% by weight sulfur.

Example G: 390.0 grams of monosuccinimide as prepared in Example E and 304.4 grams of neutral oil were charged to a glass reactor equipped with a temperature controller, mechanical stirrer, and water cooled condenser. The mixture was heated to molybdation reaction temperature 80° C. While at reaction temperature, 88.2 grams of molybdenum oxide and 75.8 grams of water were charged to the reactor. The reactor was then held at reaction temperature 80° C. for 22 hours. Upon completion of the molybdation reaction, water was removed by distillation that was carried out at temperature 99° C. and a pressure of 25 millimeters of mercury (absolute) or less for approximately 30 minutes. The product contained 1.80% by weight nitrogen and 7.55% weight molybdenum and an absorbance intensity of about 0.203 at a wavelength of 350 nanometers.

Example H: 10,864.0 grams of monosuccinimide as prepared in Example 3 and 5292.0 grams of neutral oil were charged to a stainless steel reactor equipped with a temperature controller, mechanical stirrer, and water cooled condenser. The mixture was heated to molybdation reaction temperature 80° C. While at reaction temperature, 1602.0 grams of molybdenum oxide and 689.0 grams of water were charged to the reactor. The reactor was then held at reaction temperature 80° C. for 7.8 hours. Upon completion of the molybdation reaction, water was removed by distillation that was carried out at temperature 99° C. and a pressure of 25 millimeters of mercury (absolute) or less for approximately 30 minutes. The reaction mixture was then adjusted to the sulfurization temperature 80° C. 5.3 grams of sulfur were charged to the reactor. The sulfurization reaction was carried out for 0.5 hours. The product contained 1.59% by weight nitrogen, 5.73% by weight molybdenum, and 0.29% by weight sulfur and an absorbance intensity of about 0.242 at a wavelength of 350 nanometers.

Performance Examples

The base line formulation employed formulated oil employing a lubricating oil and additives in their typical amounts for particular purpose; this included a Group II base oil of a viscosity grade of 5W20, 3.4 wt % of a 2300 molecular weight post treated ethylene carbonate bissuccinimide dispersant, 0.07 wt % of a low overbase TBN 17 calcium sulfonate, 2.4 wt % of a high overbase TBN 250 calcium phenate, 0.6 wt% of a secondary alcohol ZnDTP, and a viscosity index improver.

EXAMPLE 1–4

Friction measurements were made using a Mini-Traction Machine manufactured by PCS Instruments. Friction coefficients were measured with the Mini-Traction Machine using the pin-on disk attachment. The pin specimen is secured and be loaded against 46 mm diameter disc. The tests were run at a load of 25 N, a speed of 500 mm/s and a temperature of 150 ° C.; test time and resulting friction coefficient are illustrated in FIG. 1.

Example 1, tested the friction coefficient for the base line formulation alone used as a control formulation, and Example 2 was performed with the control formulation and a) 500 ppm on the basis of molybdenum of oil soluble sulfur containing oxymolybdenum complex prepared from reacting, in the presence of a polar promoter, an acidic molybdenum compound and a basic nitrogen polyisobutenyl succinimide made in accordance with U.S. Pat. No. 4,263,152 representative compounds are shown in Examples A and B. Additionally, Example 3 tested the control formulation with the addition of b) 80 ppm on the basis of molybdenum of a molybdenum compound of formula I wherein $X^1$ and $X^2$ are O,$X^3$ and $X^4$ are S and $R^1$ to $R^4$ are a mixture of alkyl $C_8$ and $C_{13}$. Example 4 tested the control formulation with the addition of 420 ppm of the component of Example 2 with Example 3. The results are shown in FIG. 1 and in Table 2 shown for the end of test time average from 2400 seconds to 3000 seconds or t2400–3000 average.

TABLE 2

| Example No. | Sulfurized oxymolybdenum nitrogen dispersant complex (a) ppm Mo | MoDTC (b) ppm Mo | MTM pin on disc results ($t_{2400–3000\ average}$) |
|---|---|---|---|
| 1 | — | — | 0.137 |
| 2 | 500 | — | 0.116 |
| 3 | — | 80 | 0.105 |
| 4 | 420 | 80 | 0.063 |

These results clearly show the synergistic friction modification of combining a sulfurized oxymolybdenum nitrogen dispersant and a sulfurized oxymolybdenum dithiocarbamate. As seen from the table and the figure, there is a dramatic improvement in the two component mixture over the individual components. Moreover while molybdenum is deemed to be the active agent in the sulfurized oxymolybdenum nitrogen dispersant for friction modification a reduction in the molybdenum concentration in the two component mixture still lead to improved results at low concentrations. If these results were additive, the calculated friction coefficient for a two component system similar to Example 4 at $t_{2400-3000}$ average seconds would be approximately a friction coefficient of 0.087. The additive friction coefficient effect in this time frame was determined from the baseline by taking the contribution of MoDTC and a weighted contribution of the sulfurized oxymolybdenum complex (i.e. 0.137–0.105–420/500*0.116). However, as demonstrated from comparing the actual results of Example 4 (even at a lower molybdenum concentration) with Examples 2 and 3 the unexpected synergy leads to a lower friction coefficient than would be expected if the results were merely additive.

EXAMPLES 5–17

Friction measurements were made using a high frequency reciprocating rig (HFRR) test which has been described by D. Wei, H. Spikes, Wear, Vol.111, No. 2, p. 217,1986. The HFRR parameters in Examples 5–9 were 120 degree C oil temperature, 1000 gram load, 20 Hz stroke frequency and 1 mm stroke length for 60 minute duration. In Examples 10–17 the oil temperature was 105 degree C. in a 30 minute test duration, the other parameters being similar. The disks were 650 Hv, AISI 52100 steel, polished to 0.05 micron Ra roughness.

Results for Examples 5 through 17 are illustrated in Table 3. The displayed HFRR results are the average of at least three full length runs. These examples used the formulated oil package as above (Example 1) and the same molybdenum dithiocarbamate as Example 2. Examples 7–8 employed the same oxymolybdenum complex as Example 3. Examples 9–16 used low temperature oxymolybdenum complex prepared in accordance with Examples C through H. Particularly, Example 9 employed the nonsulfurized oxymolybdenum complex prepared in accordance with Example E and Examples 10–17 employed the sulfurized oxymolybdenum complex prepared in accordance with Example F.

The Examples so indicated additionally employed c) an ashless dithiocarbamate, a methylenebis (dibutyldithiocarbamate).

TABLE 3

| Example No. | Oxymolybdenum nitrogen dispersant complex (ppm Mo) | MoDTC (b) (ppm Mo) | Ashless DTC (c) Wt % | HFRR results (avg.) |
|---|---|---|---|---|
| 5 | — | — | — | 0.140 |
| 6 | — | 80 | — | 0.122 |
| 7 | 500 | — | — | 0.086 |
| 8 | 420 | 80 | — | 0.068 |
| 9 | 500 | — | — | 0.074 |
| | New HFRR test parameters | | | |
| 10 | 400 | — | — | 0.120 |
| 11 | 400 | 80 | — | 0.108 |
| 12 | 400 | — | 0.40 | 0.117 |
| 13 | 400 | 80 | 0.40 | 0.103 |
| 14 | 800 | — | — | 0.101 |
| 15 | 800 | 80 | — | 0.064 |
| 16 | 800 | — | 0.40 | 0.08 |
| 17 | 800 | 80 | 0.40 | 0.066 |

*Concentration in weight percent the lubricating oil composition from the component: sulfurized oxymolybdenum nitrogen dispersant complex at 400 ppm Mo is equivalent to 1.00 wt % and at 800 ppm Mo is equivalent to 2.00 wt %; MoDTC at 80 ppm Mo is equivalent to 0.20 wt %.

As seen from Table 2 compositions employing an additive containing a combination of organomolybdenum compounds, ie. a sulfurized or unsulfurized oxymolybdenum nitrogen dispersant in addition to a molybdenum dithiocarbamate wherein the composition contains over 450 ppm Mo provide superior friction coefficients over each of the compounds individually.

EXAMPLES 18–19

These examples explored the dependence of detergent to the overall frictional coefficient. An experimental design on two formulation variables was performed. The variables were the presence of the oxymolybdenum complex and sulfurized molybdenum dithiocarbamate and either calcium phenate overbased detergent (as outlined in Examples 1–5) or a overbased calcium sulfonate (12.75% calcium, 1.95% sulfur, 320 TBN) which was employed in equal TBN to the calcium phenate detergent it replaced. For ease of comparison, the results from Examples 5 and 8 are present along with Examples 18 and 19 in Table 4.

TABLE 4

| Example No. | Oxymolybdenum nitrogen dispersant complex (ppm Mo) | MoDTC (b) (ppm Mo) | Detergent Type | HFRR results (avg.) |
|---|---|---|---|---|
| 5 | — | — | phenate | 0.140 |
| 8 | 420 | 80 | phenate | 0.068 |
| 18 | — | — | sulfonate | 0.119 |
| 19 | 420 | 80 | sulfonate | 0.106 |

As seen from comparing the results in Table 3, the degree of reduction in the friction coefficient is strongly dependent upon detergent type employed and by the addition of the molybdenum complex.

What is claimed is:

1. A lubricating oil composition comprising a major amount of an oil of lubricating viscosity and at least 450 ppm molybdenum based upon the total mass of the composition of a friction modifier composition containing:

(a) an oil soluble oxymolybdenum complex prepared from reacting, in the presence of a polar promoter, an acidic molybdenum compound and a basic nitrogen compound selected from the group consisting of a succinimide, a carboxylic acid amide, a hydrocarbyl monoamine, a hydrocarbyl polyamine, a Mannich base, a phosphoramide, a thiophosphoramide, a phosphonamide, a dispersant viscosity index improver; and (b) a molybdenum dithiocarbamate of the formula I

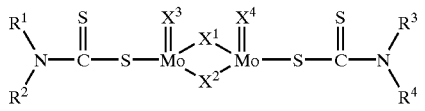

wherein $R^1$, $R^2$, $R^3$ and $R^4$, are independently selected from a hydrocarbon group; $X^1$ to $X^4$ are independently selected from sulfur or oxygen atom; wherein said molybdenum dithiocarbamate is present below 175 ppm in terms of molybdenum concentration, based upon the total mass of the composition.

2. The lubricating oil composition of claim 1 further comprising a calcium phenate detergent.

3. The lubricating oil composition of claim 2 wherein the calcium phenate detergent has a TBN of 200 to 400.

4. The lubricating oil composition of claim 1 further comprising an ashless dithiocarbamate.

5. The lubricating oil composition of claim 4 wherein the ashless dithiocarbamate is methylenebis (dibutyldithiocarbamate).

6. The lubricating oil composition of claim 1 wherein the oil soluble oxymolybdenum complex is reacted with a sulfur containing compound to form a oil soluble sulfur containing oxymolybdenum complex.

7. The lubricating oil composition of claim 6 wherein the oil soluble sulfur containing oxymolybdenum complex is prepared having a sulfur to molybdenum weight ratio from 0.05–0.5:1 and a nitrogen to molybdenum weight ratio from 2–5:1.

8. The lubricating oil composition of claim 1 wherein the total molybdenum concentration of the composition is 500 to 2000 ppm.

9. The lubricating oil composition of claim 1 wherein the ratio of component (a) to (b) is from 2:1 to 20:1.

10. The lubricating oil composition of claim 9 wherein the ratio of component (a) to (b) is from 5:1 to 10:1.

11. The lubricating oil composition of claim I wherein the oil soluble oxymolybdenum complex is prepared at a reaction temperature at or below about 120° C. to provide a product having a absorbance intensity of less than 0.7 at a wavelength of 350 nanometers as measured in a one centimeter path-length quartz cell in a UV-Visible spectrophotometer after diluting the oxymolybdenum complex with isooctane to a reference molybdenum concentration of 0.00025 grams of molybdenum per gram of the diluted oxymolybdenum complex product.

12. The lubricating oil composition of claim 11 wherein the oxymolybdenum complex is reacted at a reaction temperature at or below about 120° C. with a sulfur containing compound to form a oil soluble sulfur containing oxymolybdenum complex.

13. The lubricating oil composition of claim 12 wherein the oil soluble sulfur containing oxymolybdenum complex is prepared having a sulfur to molybdenum weight ratio from 0.05–0.5:1 and a nitrogen to molybdenum weight ratio from 2–5:1.

14. The lubrication oil composition of claim 13 wherein the reaction temperature is from about 70° C. to about 90° C. and the sulfur to molybdenum weight ratio is 0.4:1 or less.

15. The lubricating oil composition of claim 1 wherein the basic nitrogen compound is a succinimide.

16. The lubricating oil composition of claim 1 wherein the polar promoter is water.

17. The lubricating oil composition according to claim 1 wherein molybdenum dithiocarbamate is present at or below 100 ppm in terms of molybdenum concentration, based upon the total mass of the composition.

18. The lubricating oil composition according to claim 17 wherein molybdenum dithiocarbamate is present from 50 to 90 ppm in terms of molybdenum concentration, based upon the total mass of the composition.

19. The lubricating oil composition of claim 1 wherein $R^1$ to $R^4$ is independently selected from an alkyl group having 6 to 13 carbon atoms and $X^1$ to $X^4$ has a ratio of S/O of 2.0/2.0.

20. The lubricating oil composition of claim 19 wherein $R^1$ to $R^4$ are 12 or 13 carbon atoms.

21. The lubricating oil composition of claim 1 further comprising at least one phosphorous compound employed at a concentration of total phosphorous below 0.05 weight percent phosphorous based upon the total mass of the composition.

22.A lubricating oil composition comprising a major amount of an oil of lubricating viscosity and about 0.1 to 10.0 percent by weight of a friction modifier composition containing:

(a) an oil soluble sulfur containing oxymolybdenum complex prepared from reacting, in the presence of a polar promoter, an acidic molybdenum compound, and a basic nitrogen succinimide compound or mixtures thereof; and optionally reacting the resulting complex with a sulfur-containing compound;

(b) a molybdenum dithiocarbamate of the formula I

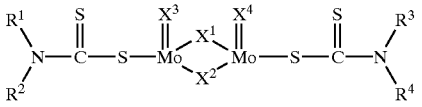

wherein $R^1$, $R^2$, $R^3$ and $R^4$, are independently selected from a hydrocarbon group; $X^1$ to $X^4$ are independently selected from sulfur or oxygen atom; wherein said molybdenum dithiocarbamate is present below 125 ppm in terms of molybdenum concentration, based upon the total mass of the composition;

(c) a calcium phenate detergent; and (d) an ashless dithiocarbamate.

23. A method for improving the friction reduction performance in a lubricating oil comprising adding to the lubricating oil an effective amount an oil soluble or dispersible friction modifier composition containing:

(a) an oil soluble sulfur containing oxymolybdenum complex prepared from reacting, in the presence of a polar promoter, an acidic molybdenum compound and a basic nitrogen compound selected from the group consisting of a succinimide, a carboxylic acid amide, a hydrocarbyl monoamine, a hydrocarbyl polyamine, a Mannich base, a phosphoramide, a thiophosphoramide, a phosphonamide, a dispersant viscosity index improver, or a mixture thereof; and optionally reacting the resulting complex with a sulfur-containing compound; and (b) a molybdenum dithiocarbamate of the formula I

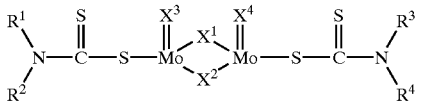

wherein $R^1$, $R^2$, $R^3$ and $R^4$, are independently selected from a hydrocarbon group; $X^1$ to $X^4$ are independently selected from sulfur or oxygen atom; wherein said molybdenum dithiocarbamate is present below 175 ppm in terms of molybdenum concentration, based upon the total mass of the composition.

24. The method of claim 23 wherein said friction modifier composition further comprises a calcium phenate detergent.

25. The method of claim 23 wherein said friction modifier composition further comprises an ashless dithiocarbamate.

26. The method of claim 23 wherein said molybdenum dithiocarbamate is present at or below 100 ppm in terms of molybdenum concentration, based upon the total mass of the composition.

27. The method of claim 23 wherein said molybdenum dithiocarbamate is present at from 50 to 90 ppm in terms of molybdenum concentration, based upon the total mass of the composition.

* * * * *